United States Patent [19]

Bartfield et al.

[11] Patent Number: 4,618,073

[45] Date of Patent: Oct. 21, 1986

[54] CUP DISPENSING APPARATUS

[76] Inventors: William Bartfield, 15150 Dickens St., #304, Sherman Oaks, Calif. 91403; Charles L. Ferguson, 779, Manchester, N.H. 03105

[21] Appl. No.: 728,523

[22] Filed: Apr. 29, 1985

[51] Int. Cl.[4] ..... G07F 11/12

[52] U.S. Cl. ..... 221/11; 221/104; 221/222; 414/126

[58] Field of Search ..... 414/126–127; 221/10–11, 17, 75, 92, 96–98, 103–108, 191, 221–223, 289, 297–298

[56] References Cited

U.S. PATENT DOCUMENTS

| | | | |
|---|---|---|---|
| 1,881,894 | 10/1932 | Olsen | 221/106 X |
| 2,497,718 | 2/1950 | Earley et al. | 221/104 X |
| 2,946,480 | 7/1960 | Farber | 221/106 |
| 4,181,162 | 1/1980 | Newman et al. | 221/96 X |

FOREIGN PATENT DOCUMENTS

| | | | |
|---|---|---|---|
| 1501845 | 11/1967 | France | 221/96 |
| 1152414 | 5/1969 | United Kingdom | 221/11 |

*Primary Examiner*—Joseph J. Rolla
*Assistant Examiner*—Michael S. Huppert
*Attorney, Agent, or Firm*—Fleit, Jacobson, Cohn & Price

[57] ABSTRACT

A cup dispenser for housing a plurality of stacks of nested cups in side-by-side relationship and including a dispensing device to sequentially dispense cups from one of the stacks in a dispensing column. A pair of helical feed coils are provided to advance the stacks of cups sequentially to the dispensing column. A support in the form of a pivotable platform is provided below the dispensing column to receive and support the stacks as they enter the dispensing column and drop through a dispensing column opening in order to avoid damage to the outwardly extending lip of the lowermost cup by virtue of the weight of the stack. The support is particularly suitable to catch falling stacks of cups that include packaged materials that are provided with the cup, such as seasonings or condiments carried in the recess at the base of the cups.

11 Claims, 9 Drawing Figures

FIG. 8
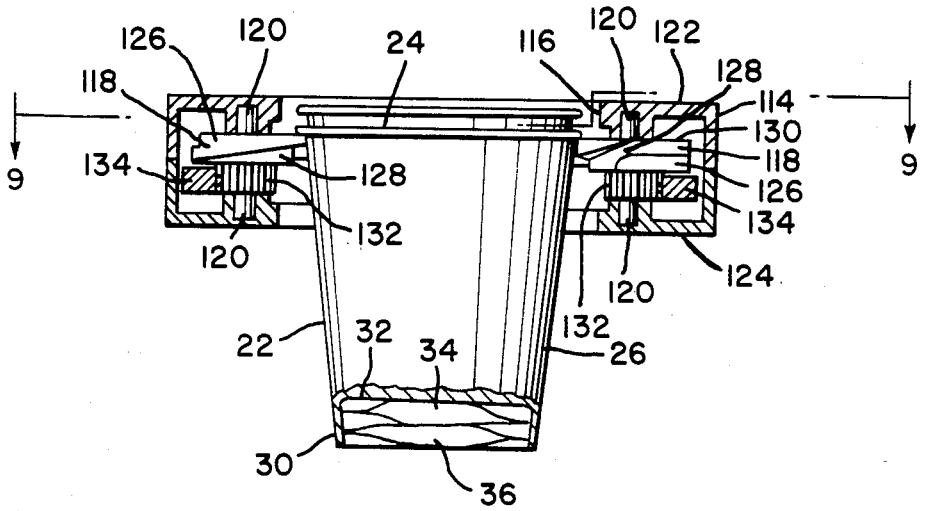
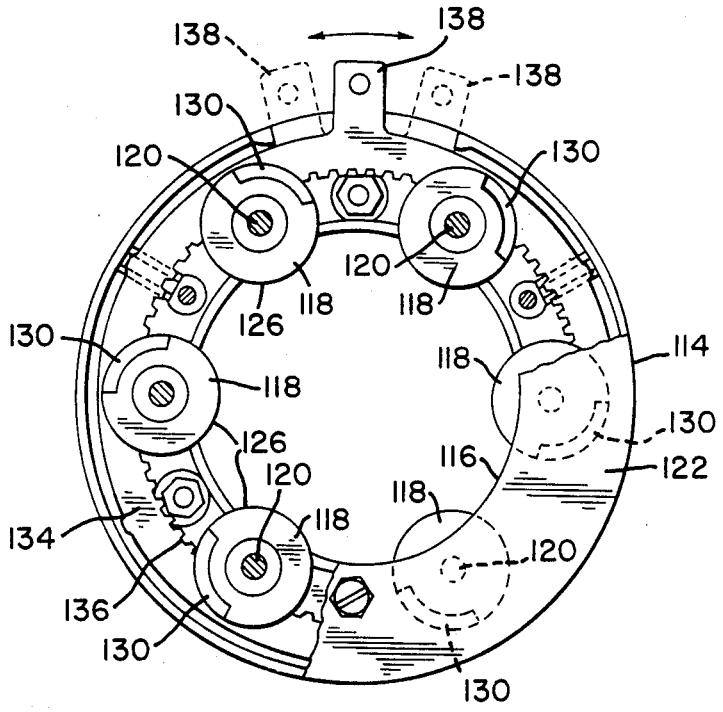
FIG. 9

CUP DISPENSING APPARATUS

BACKGROUND OF THE INVENTION

1. Field of the Invention

This invention relates to apparatus for dispensing cups, and more particularly to an apparatus for dispensing thin-wall paper or plastic cups provided in nested stacks within a housing and adapted for individual separation from the stack to contain products to be dispensed from a vending machine.

2. Description of the Prior Art

Thin-wall cups for use in dispensing machines are light weight containers for products to be dispensed and generally have a base from which an upwardly and outwardly flaring continuous side wall extends, the upper portion of the side wall having its upper edge rolled over to define an outwardly extending rim. A desirable characteristic of such cups is that they can be nested together with one cup fitting within another so that a large number of the cups can be provided in a stacked array. A number of such stacks or columns are provided in a vending machine to permit a large number of dispensing operations to take place without the need for frequent refilling of the machine with cups. A familiar example of such a container and dispensing arrangement is a soft drink vending machine wherein the cups are of paper, or wax or plastic coated paper, or even plastic alone in order to reduce their cost and their weight.

When thin-wall cups of the type hereinabove described are dispensed, a stack of nested cups is often held by a supporting device that engages the lower portion of the rim of the lowermost cup. Thus the entire weight of the stack of cups is supported by the rim of the lowermost cup, the maximum rim loading occurring at the bottommost cup of the stack and the rim loading diminishing progressively as the cups are dispensed and the height of the stack diminishes. In addition to the continuous weight of the stack once the stack is in position for dispensing of the cups, frequently when the stack of cups is moved from a storage position to the position where dispensing can take place, the stack falls a small distance through an opening into which a rim-engaging supporting means extends, and the consequent dropping of the stack results in an impact load on the rim of the lowermost cup. That condition is normally not a problem because the cups are of light weight and, in any event, the outwardly extending rims are of sufficient strength to be able to withstand both the continuous stacking loads, as well as the instantaneous impact loads.

At times it is desired that the product to be dispensed be accompanied by separate packets of condiments, seasonings, or the like, which can be positioned within the base of the cup at the recess between the lowermost edge of the side wall and the transversly-extending base wall. The recess defines an opening in which individual packets of such materials can be inserted for later use by the purchaser of the product. Thus if coffee is to be dispensed, individual packets of sugar and powdered creamer can be contained within the recess at the base of the cup. Similarly, if a product such as french-fried potatoes or some other type of food products is to be dispensed, packets of salt, ketchup, mustard, and the like can be provided in the base portion of the cup. However when additional materials such as packets of condiments and the like are carried in the recesses at the bases of the cups, the weight of the cups increases considerably with the consequent effect that the entire stack of cups is substantially heavier than is the same stack without the additional packaged materials. It has been found that by adding packets of additional materials to cups, the weight of stacks formed from such cups increases to the point where the rims of the cups are incapable of absorbing the impact load that occurs when the stack is dropped into position. The rims of the cups are damaged by being partially unrolled, bent, or being otherwise disfigured. Thus when using such cup-packet combinations, the available dispensing equipment cannot be used without cup damage, and special provisions must be made for supporting the additional weight of the stack, particularly in view of the increased impact loads imposed on the rim of the lowermost cup.

It is an object of the present invention to overcome the above-described difficulties.

SUMMARY OF THE INVENTION

Briefly stated, in accordance with one aspect of the present invention, a cup dispenser is provided for containing and individually releasing cups for dispensing of product from a vending machine. The dispenser includes housing means for housing a plurality of cups provided in nested relationship in plural tubular stacks, each of the cups having a base and an outwardly extending rim at its upper edge. One of the stacks is a dispensing stack positioned at a dispensing column including a dispensing opening, and the remaining stacks are supply stacks. Dispensing means are provided for both supporting the dispensing stack and for selectively separating single cups from the bottom of the dispensing stack to permit each of the separated cups to move to a product dispensing station. Advancing means are provided for selectively advancing one of the supply stacks of cups to the dispensing column when the initial dispensing stack is exhausted. The dispenser includes support means selectively interposable below the dispensing opening for catching and supporting each of the supply stacks after it has been advanced to the dispensing column and the lowermost cups have fallen partially through the dispensing opening. The support means is operative to support the lowermost cup of the dispensing stack at its base so that its outwardly extending rim is above the dispensing means and so that the impact of the falling dispensing stack as it falls into the dispensing opening is borne by the base of the lowermost cup in order to avoid damage to the rim of the cup.

BRIEF DESCRIPTION OF THE DRAWINGS

FIG. 8 is a front elevational view of the individual cup dispensing means.

FIG. 9 is a cross-sectional view of the cup dispenser of FIG. 8 taken along the line 9—9 thereof.

DESCRIPTION OF THE PREFERRED EMBODIMENTS

Figure 1:
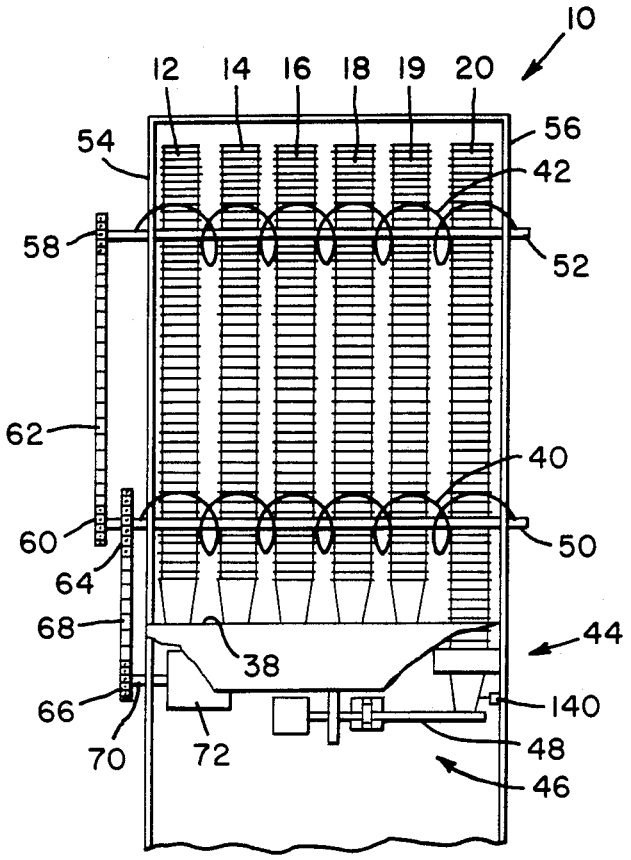
FIG. 1 is a front elevational view of a cup dispenser and housing in accordance with the present invention.

Referring now to the drawings, and particularly to FIG. 1 thereof, there is shown a cabinet 10 for housing a plurality of stacks 12, 14, 16, 18, 19, 20 of nested cups. The positioning of the cups is best seen in FIG. 8 wherein two cups 22, 24 are shown in nested relationship. The lowermost cup 22 has had a portion of the side wall 26 broken away to illustrate the packaging in the recess 28 between the lower portion 30 of side wall 26 and the transverse bottom wall 32 of two packets 34, 36 of condiments, or the like, which are fully received in recess 28 of the cup 22. As shown in FIG. 1, six stacks of nested cups are provided, the right-most stack 20 referred to as a dispensing stack from which individual cups are adapted to be dispensed as product is to be dispensed to the purchaser. The remaining stacks 12, 14, 16, and 18 are supply stacks that are sequentially moved into dispensing position as successive dispensing stacks 20 are exhausted, in order to provide a continuous supply of cups and thereby permit a number of dispensing operations to be accomplished without the need for continuous replenishment of the cup supply.

The several stacks of cups are supported on a shelf 38 and are adapted to be slidably moved thereacross by an advancing means in the form of a pair of helical feed coils 40, 42 that engage lower and upper portions, respectively, of the several stacks and are rotated as necessary to cause the rightmost of the supply stacks (19 as shown in FIG. 1) to be advanced into the dispensing column when the original dispensing stack 20 has been exhausted.

Positioned in the dispensing column at a point below shelf 38 is a cup dispensing means 44 that serves to support dispensing stack 20 and to selectively separate single cups from the lowermost portion of the dispensing stack to permit the separated cups to move to a product dispensing station (not shown). Positioned below dispensing means 44 is a support means 46 including a platform 48 that is selectively interposable below the dispensing means 44 in order to stop and support a supply stack 20 after it has been advanced to the dispensing column, as will hereinafter be described in greater detail.

Figure 2:
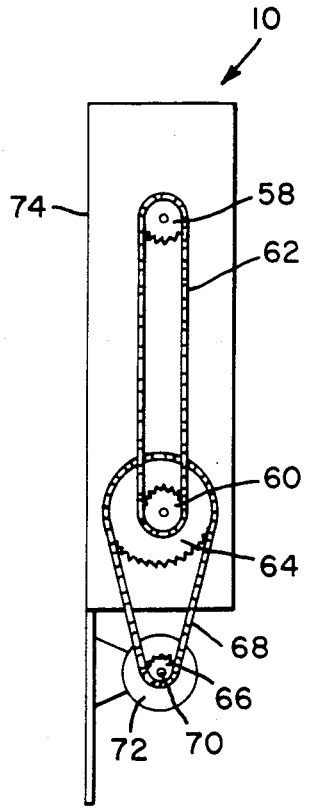
FIG. 2 is a side view of the cup dispenser housing of FIG. 1 showing the drive arrangement for moving stacks of cups from a supply position to a dispensing position.

The helical coil tubes 40, 42 for advancing the several stacks of cups are supported on shafts 50, 52, respectively, that extend across the cabinet 10 and are rotatably supported in the cabinet end walls 54, 56. One end of each of shafts 50, 52 extends beyond end wall 54 and has a driven sprocket wheel 58, 60 attached thereto, each of sprocket wheels 58, 60 having a drive chain 62 entrained therearound in driving relationship. Additionally, the lowermost shaft 50 has a second driven sprocket wheel 64 that is drivingly connected to a driving sprocket 66 by means of a second drive chain 68. Driving sprocket 66 is secured to a drive shaft 70 of a drive motor 72 that is supported on the back wall 74 of cabinet 10. The driving arrangement for the helical feed coils 40, 42 is best seen in FIGS. 1 and 2 of the drawings.

Figure 3:
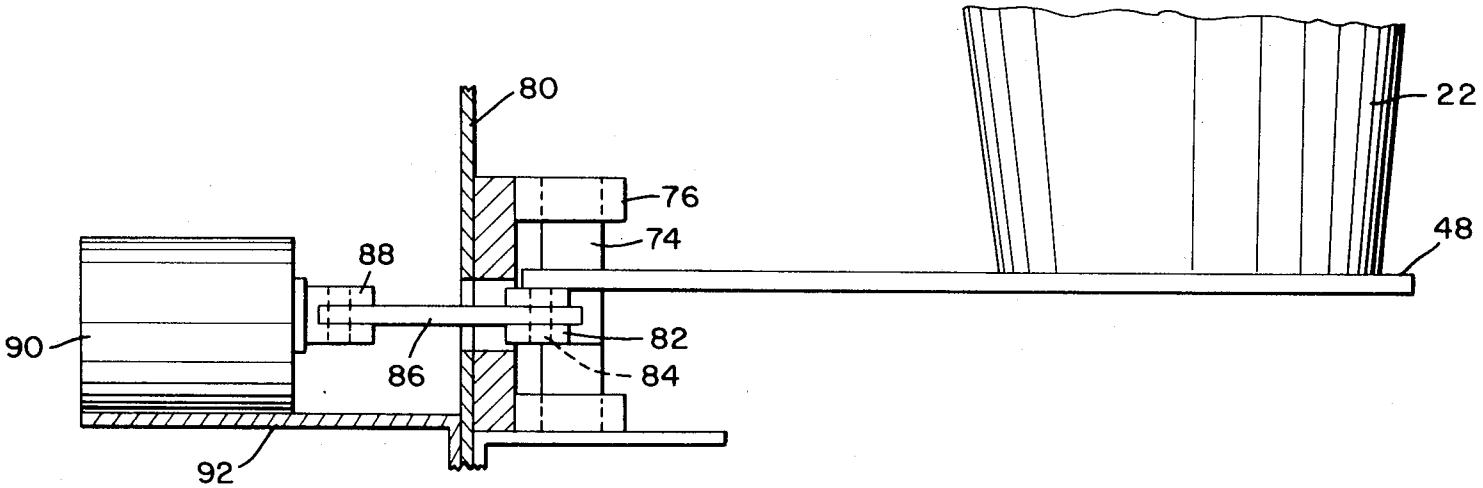
FIG. 3 is an enlarged view of a stack support means for stopping the fall of a dispensing stack and supporting it in position for engagement with a dispensing apparatus.
Figure 4:
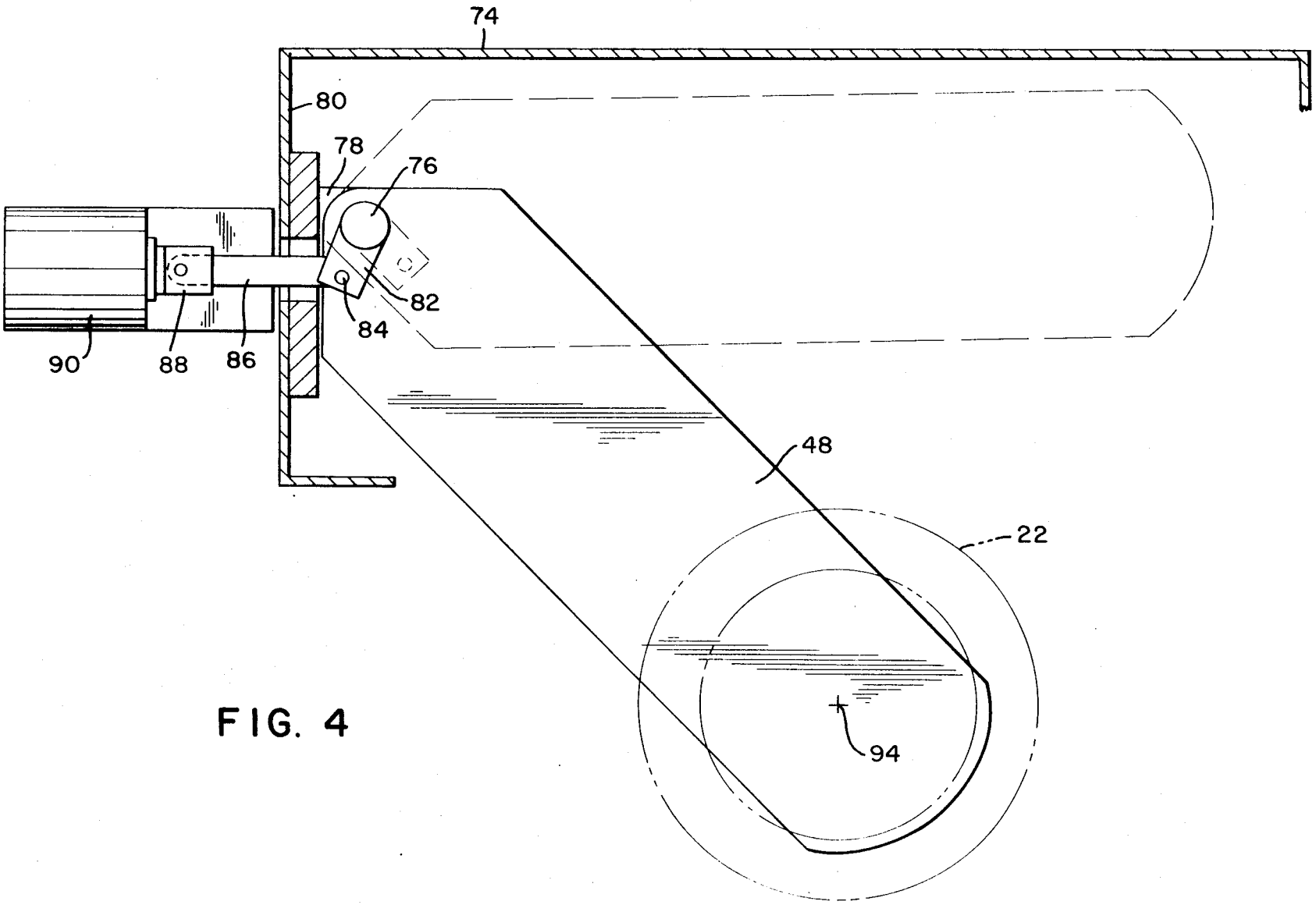
FIG. 4 is a top view of the stack support means of FIG. 3.
Figure 5:
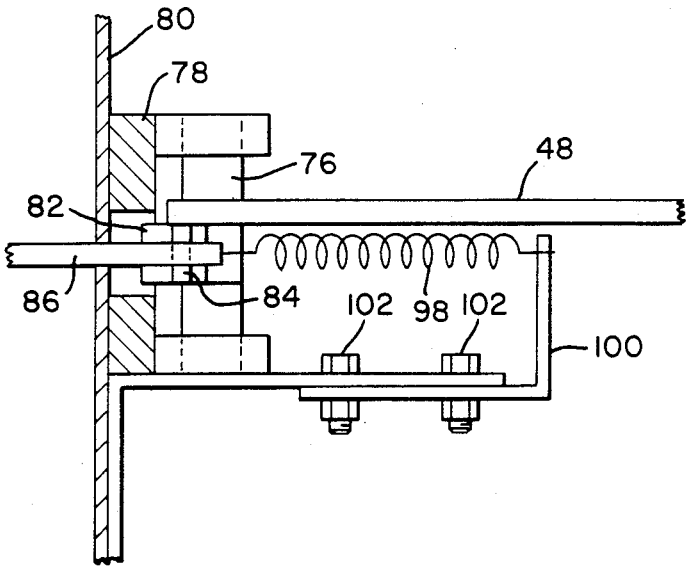
FIG. 5 is an end view of the stack support means of FIG. 3.

Support means 46 that serves to stop and to support a stack of cups as it arrives in the dispensing column is illustrated in FIGS. 3, 4, and 5. The device includes platform 48, which is of elongated form and of a size that is adapted to support the base of a cup. Platform 48 is pivotally secured to the cabinet 10 by means of a pivot pin 26 that is carried in a yoke 78 secured to a bracket 80 that extends outwardly from the back wall 24 of the cabinet 10. Pivot pin 74 includes a bell crank 82 attached thereto having a pivot pin 84 to which one end of a solenoid link 86 is attached. The opposite end of the solenoid link 86 is received in a yoke 88 that extends from a solenoid 90 supported on a bracket 92 that extends laterally from bracket 80. The platform 48, bell crank 82, and solenoid link 86 are so arranged that the platform is in retracted position, as illustrated in dashed lines in FIG. 4, and is transversely spaced from the axis 94 of the stack of cups in the dispensing column. Upon actuation, solenoid 90 pulls the solenoid link 86 and causes the platform 48 to pivot away from rear wall 74 of the cabinet 10 and into position beneath the axis 94 of the dispensing column, as illustrated in full lines in FIG. 4. Also as shown in FIG. 4, the platform includes an abutment 96 that contacts yoke 78 to limit outward movement of the platform. Further, and as best seen in FIG. 5, the platform is maintained in retracted position by means of a tension spring 98 that extends from a spring bracket 100 spaced outwardly of bracket 80 and bell crank 82. The spring tension can be adjusted by moving spring bracket 100 outwardly relative to bracket 80 by loosening bolts 102 that hold spring bracket 100 in position.

Figure 6:
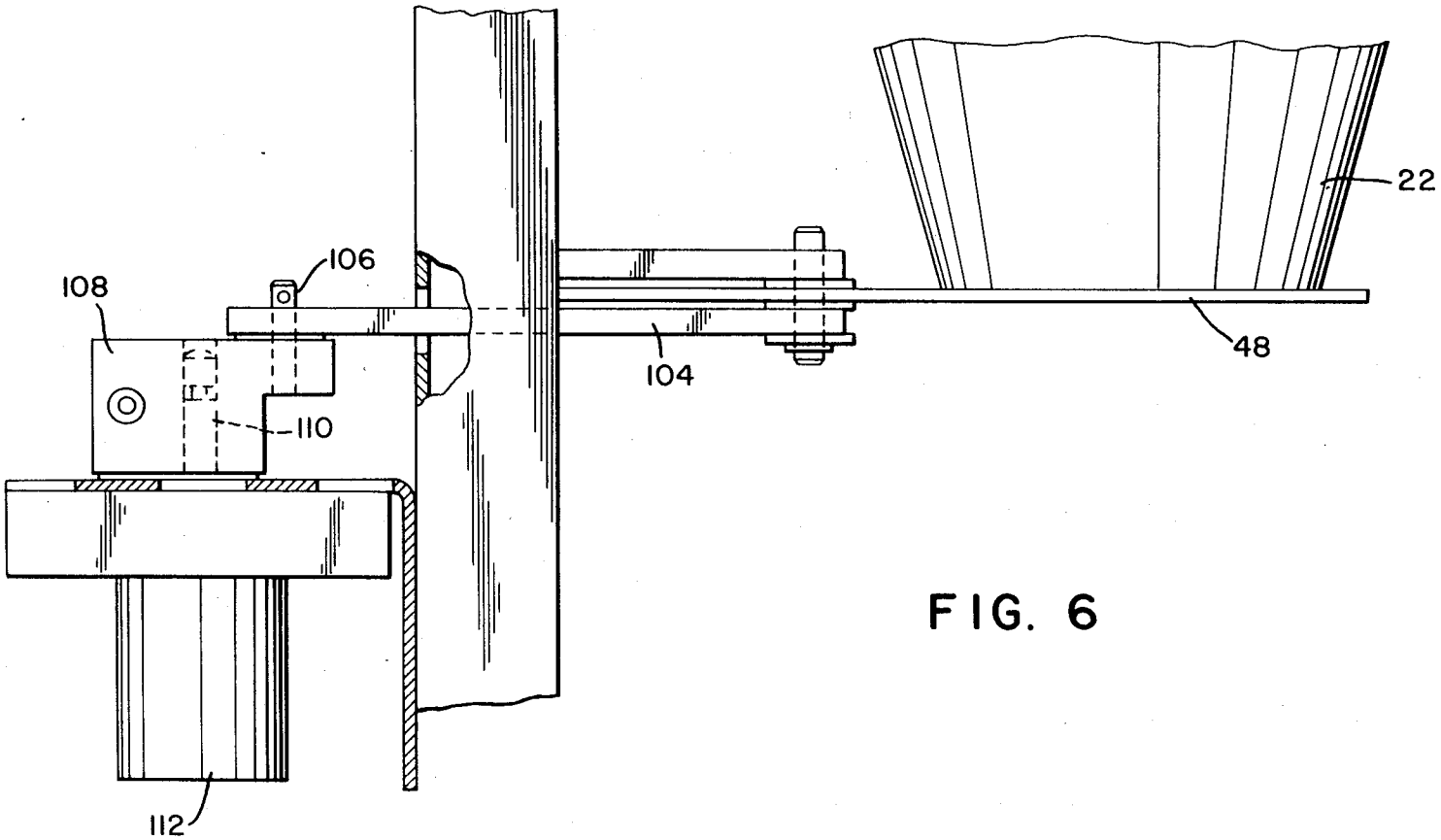
FIG. 6 is a front view of another embodiment of a stack support means.
Figure 7:
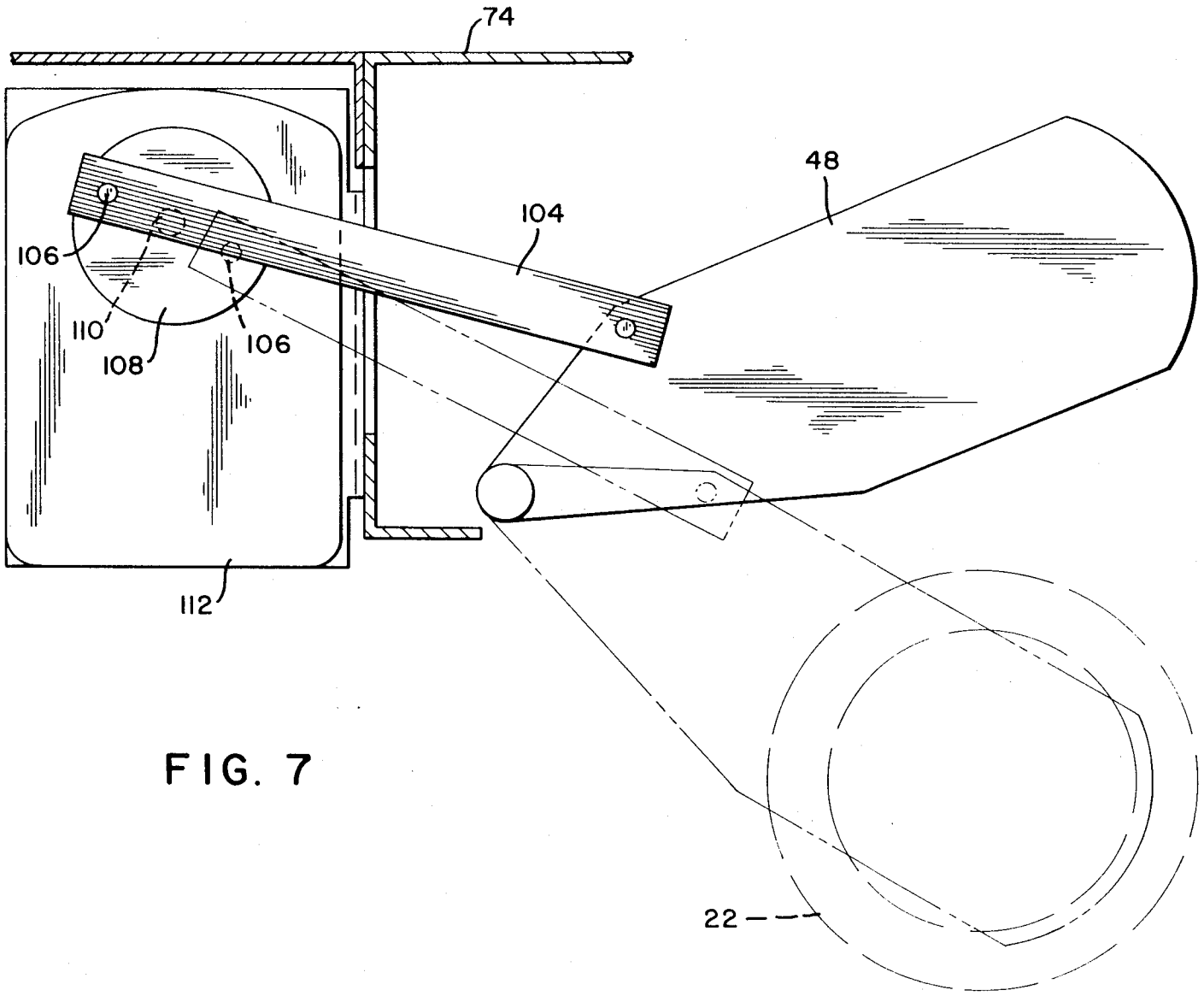
FIG. 7 is a top view of the stack support means shown in FIG. 6.

Another embodiment showing an alternative means for actuating the platform 48 is shown in FIGS. 6 and 7. As therein shown the general configuration and positioning of the platform is the same as that of the embodiment of FIGS. 3 through 5 with the exception that solenoid link 86 is replaced with a drive link 104 the distal end of which is rotatably received in a pin 106 that extends upwardly from a drive arm 108 secured to a motor shaft 110. The motor shaft is selectively driven through a part of a revolution by a servomotor 112 to alternately turn drive arm 108 in the couterclockwise direction as viewed in FIG. 7, to cause platform 48 to retract from the axis 94 of the dispensing column. Clockwise rotation of servomotor 112 causes the platform to extend outwardly from rear wall 74 of the cabinet 10 and under axis 94.

The cup dispensing means 44 serves to support the stack 20 of cups when it is in the dispensing column and also serves to dispense individual cups as is illustrated in FIGS. 8 and 9. As there shown, an annular housing 114 is provided that has a central opening 116 sufficiently large to receive a stack of cups (only two of which are shown in FIG. 8) and permit individual cups to pass therethrough. Rotatably carried within annular housing 114 are a plurality of rotatable cam members 118 that are arranged with their axes parallel to the axis of the dispensing column. Cam members 118 are disposed substantially equally around annular housing 114 and extend partly into the central opening 116 thereof. Each of the cam members is of generally cylindrical configuration and includes a pivot pin 120 extending from each end thereof, the pivot pins rotatably carried in the upper and lower surfaces 122, 124 of annular housing 114, respectively. The outer face 126 of each of cam members 118 includes a peripheral, generally helical cam groove 128, the uppermost termination of the helical cam groove 128 defining a receiving opening 130 for receiving a portion of the outwardly extending rim of a cup.

Each of the cam members 118 includes a driven gear 132 secured thereto and in driving engagement with a ring gear 134 that includes internal gear teeth 136 that are so disposed as to simultaneously engage all of the individual drive gears 132 of the individual cam members 118. Ring gear 134 is supported for rotation about the central axis of the annular housing and includes an outwardly extending drive arm 138 that is suitably moved circumferentially in a controlled fashion to cause ring gear 134 to travel between the drive arm positions illustrated in dashed line on FIG. 9. Thus dispensing means 44 supports the stack 20 of cups and selectively releases the bottommost cup of the stack to a dispensing station (not shown).

In operation, a plurality of stack 12, 14, 16, 18, 19, and 20 of cups are positioned within the cabinet 10 so that the several stacks are aligned and positioned between the respective openings in the loops of the helical feed coils 40, 42. The right-most stack 20 is manually inserted so that the lowermost cup 22 has its rim resting on the respective cam members 118 with the other cups of the stack extending upwardly therefrom in nested relationship. When it is desired that a cup be advanced to a dispensing station for receiving product to be distributed to the purchaser, the ring gear 134 is caused to rotate and the rotation thereof causes the individual cam members 118 to rotate so that the rim of the lowermost cup 22 is simultaneously carried in the second cam grooves 128 and is guided downwardly until the rim passes the lower ends of the respective cam grooves, so that the cup is released from the stack, whereupon it falls of its own weight along a suitable path to a product dispensing station (not shown). By virtue of the weight of the stack of cups the stack moves downwardly so that the next cup is now the lowermost cup and has its outwardly extending rim in engagement with the several cam members 118, which at that point have been rotated by the ring gear so that the rim of the lowermost cup is resting against the receiving opening 130 of the cam members 118.

When all of the cups that form the dispensing stack have been discharged to the product dispensing station, the absence of cups is sensed by a switch 140 that energizes drive motor 72 to cause the helical feed coils 40, 42 to advance the several stacks of cups transversely along the shelf 38 of the cabinet 10 so that the rightmost of the stacks, as seen in FIG. 1, is transported to the dispensing column. Before the right-most supply stack reaches the dispensing column, the solenoid, or the servomotor 112, depending upon the embodiment that is utilized for the platform drive means, is energized to cause the platform to pivot from a retracted position to an extended position so that it underlies the dispensing column and is positioned substantially axially thereof. When the supply stack of cups reaches the dispensing column, the cups fall through the opening and the falling stack is stopped by virtue of the contact by the base of the lowermost cup with the upper surface of the platform 48. At that position the rim of the lowermost cup is slightly above the cam members 148. Thereafter, the platform is pivoted back to its retracted position, whereupon the stack of cups falls a small distance so that the outwardly extending rim of the lowermost cup engages the respective cam members 118, as illustrated in FIG. 8. As the cups are sequentially dispensed, the exhaustion of the new dispensing stack causes the position switch 140 to be activated once again so that the next succeeding supply stack is advanced to the dispensing column in the same manner as hereinbefore described, and that process is carried out until all of the cups have been dispensed from the machine. If desired, and as well known to those skilled in the art, means can be provided to cause a signal to be generated when the last cup has been dispensed in order to provide an aural or a visual indication that refilling of the housing with additional stacks of cups is required.

Although particular embodiments of the present invention have been illustrated and described, it will be apparent to those skilled in the art that various changes and modifications can be made without departing from the spirit and scope of the invention, and it is intended to emcompass within the appended claims all such changes and modifications that fall within the scope of the prevent invention.

What is claimed is:

1. A cup dispenser for containing and individually releasing cups for dispensing a product from a vending machine, said dispenser comprising:

a. housing means for housing a plurality of cups provided in nested relationship in plural tubular stacks, each of said cups having a base and including an outwardly extending rim at its upper edge, one of said stacks being a dispensing stack positioned at a dispensing column having a dispensing column opening, and the remaining stacks being supply stacks;

b. dispensing means for supporting said dispensing stack and for sequentially separating single cups from the bottom of said dispensing stack to permit each of the separated cups to drop from the dispensing means;

c. advancing means for selectively advancing at least one of said supply stacks to the dispensing column when the initial dispensing stack is exhausted; and d. support means selectively interposable below said dispensing opening for receiving and supporting each said supply stack after it has been advanced to the dispensing column and the lowermost cups have fallen partially through said dispensing column opening, said support means operative to support the lowermost cup of the dispensing stack at its base so that its outwardly extending rim is above said dispensing means, whereby the impact of the falling dispensing stack as it falls into the dispensing column opening is borne by the base of the lowermost cup to thereby avoid damage to the rim of that cup.

2. The cup dispenser of claim 1 wherein said dispensing means includes an annular ring having a central opening to permit cups to pass therethrough, said annular ring having a plurality of circumferentially spaced rotatable cam members extending partly into said central opening to engage the rim of a cup, and means to cause said cam members to selectively release a single cup and support the remaining cups of the stack.

3. The cup dispenser of claim 2 wherein said cam members are substantially equidistantly spaced around said annular ring and include peripheral cam grooves adapted to engage an outwardly extending lip of a cup to be released thereby.

4. The dispenser of claim 3 wherein said cam members each include gear means, and a ring gear concentric with and positioned within said annular ring and having a gear surface in engagement with the gear means of each of said cam members, so that rotation of said ring gear causes simultaneous rotation of each of said gear means to rotate said cam members and thereby release the lowermost cup of a stack of cups.

5. The cup dispenser of claim 1 wherein said advancing means includes at least one helical feed coil, said at least one feed coil positioned for engagement with each of the supply stacks in said housing means, said helical feed coil being rotatable about its axis to advance said supply stacks toward said dispensing column, and means to rotate said helical feed coil.

6. The cup dispenser of claim 1 wherein said at least one helical feed coil is carried on a shaft rotatably supported in said housing means and means to rotate said shaft to cause said helical coil to rotate.

7. The cup dispenser of claim 1 wherein said support means includes a platform selectively pivotable from a retracted position to an extended position in which it lies on the axis of said dispensing column to receive and support a stack of supply cups that has been advanced to the dispensing column.

8. The cup dispenser of claim 7 wherein said support means includes means to pivot said platform, said pivot means including a pivot pin pivotally carried by said housing means and secured to said platform, and a bell crank secured to said pivot pin, and means for actuating said bell crank to cause said platform to pivot about the axis of said pivot pin.

9. The cup dispenser of claim 8 wherein said actuating means includes a lever having the end pivotably carried by said bell crank and a solenoid pivotally connected with the other end of said lever to actuate said lever and thereby move said platform.

10. The cup dispenser of claim 8 wherein said actuating means includes a lever having one end pivotably carried by said bell crank and a servomotor having a shaft including an operating arm pivotally connected with the other end of said lever to actuate said lever and thereby move said platform.

11. The cup dispenser of claim 9 wherein said actuating means includes biasing means to bias said platform into said retracted position.

* * * * *